US005121761A

United States Patent [19]

Meister

[11] Patent Number: 5,121,761

[45] Date of Patent: Jun. 16, 1992

[54] METHOD FOR ATTACHING HAIR EXTENSIONS

[76] Inventor: Karen L. Meister, 1032 San Jacinto, #1913, Irving, Tex. 75063

[21] Appl. No.: 586,689

[22] Filed: Sep. 24, 1990

[51] Int. Cl.[5] ..... A41G 3/00; A41G 5/00

[52] U.S. Cl. ..... 132/201; 132/53

[58] Field of Search ..... 132/53, 54, 56, 200, 132/201

[56] References Cited

U.S. PATENT DOCUMENTS

| | | | |
|---|---|---|---|
| 2,621,663 | 12/1952 | Jenkins | 132/201 |
| 2,865,380 | 12/1958 | Mitchell | 132/201 |
| 3,295,534 | 1/1967 | Dorkin | 132/201 |
| 3,530,862 | 9/1970 | Hudson | 132/201 |
| 4,284,092 | 8/1981 | Auretta | 132/53 |
| 4,307,908 | 12/1981 | Donaldson | 132/200 |
| 4,372,330 | 2/1983 | Nelson | 132/201 |
| 4,600,029 | 7/1986 | Ueberschaar | 132/53 |
| 4,830,029 | 5/1989 | Bird | 132/54 |
| 4,934,387 | 6/1990 | Megna | 132/201 |

FOREIGN PATENT DOCUMENTS

| | | | |
|---|---|---|---|
| 2235060 | 2/1974 | Fed. Rep. of Germany | 132/201 |
| 3722108 | 1/1989 | Fed. Rep. of Germany | 132/201 |
| 2390118 | 1/1979 | France | 132/53 |

*Primary Examiner*—John J. Wilson
*Assistant Examiner*—Frank A. LaViola
*Attorney, Agent, or Firm*—Geoffrey A. Mantooth

[57] ABSTRACT

The methodd provides for the attachment of extensions or wefts of hair to the naturally growing hair of a person. First, the location of where the extension is to be attached to the person is determined. Then, the hair is parted along that location. The hair along the part is gathered together in small clumps. A crimpable anchor device is located onto each clump of hair. Each anchor device is positioned along the respective hair clump to a position near the scalp of the person. The anchor devices are crimped so as to secure their positions. Then, the extension is sewn to the clumps of hair using needle and thread. The needle and thread pass through the respective clumps at locations between the anchor devices and the scalp. The naturally growing hair is allowed to fall in place so as to cover the points of attachment.

2 Claims, 2 Drawing Sheets

METHOD FOR ATTACHING HAIR EXTENSIONS

FIELD OF THE INVENTION

The present invention relates to methods of attaching extensions or wefts of hair to naturally growing hair, and in particular to naturally growing hair on human beings.

BACKGROUND OF THE INVENTION

Extensions or wefts of hair are multiple strands of hair coupled together in a unit. The strands of hair form a linear assemblage such that the individual hairs are located side by side and such that the individual hairs are all parallel to each other (see FIG. 6).

Extensions are used for cosmetic purposes wherein they are attached to the head of a human so as to be interspersed with the naturally growing hair of the human. Extensions are commonly used to stylize a person's hair by extending the length of hair or by increasing the volume of hair.

Extensions are usually made of natural human hair, although they can be made of synthetic hair. Extensions are commercially available in a variety of colors and textures.

It is important to secure the extensions to a person's head with a minimum of discomfort to that person. Prior art methods of attaching hair extensions involve either the use of adhesives or a technique known as weaving. When adhesives are used, the extensions are glued to the person's naturally growing hair. Weaving involves first weaving a braid of the naturally growing hair. Then, an extension is stitched to the braid with needle and thread. Both of these prior art techniques are unsatisfactory in that both attach extensions in manners that are short-lived. As the naturally growing hair grows out after a few weeks, the extensions must be removed and replaced; a time consuming task. Removal is particularly difficult when glue is used to attach the extensions. What is needed is a method for attaching extensions of hair to a person's head, which method allows easy removal of the extensions and which allows readjustment of the positions of the extensions relative to the person's scalp.

SUMMARY OF THE INVENTION

It is an object of the present invention to provide a method for attaching extensions of hair to a person's head which method allows the extensions to be easily removed.

It is another object of the present invention to provide a method for attaching extensions of hair to a person's head, which method allows the extensions to be easily reworked and readjusted to compensate for the growth of the naturally growing hair.

The method of the present invention attaches an extension of hair to hair growing naturally from skin. The method determines the location on the skin where the extension is to be attached. The naturally growing hair is gathered into plural clumps that extend along the location where the extension is to be attached. An anchor means is located on each clump of naturally growing hair a short distance from the skin. Each of the anchor means is then secured to the respective clump of naturally growing hair such that the anchor means is coupled to the respective clump. The extension of hair is secured to the clumps of naturally growing hair with filament means at locations between the anchor means and the skin. The filament means couples the extension of hair to the clumps of naturally growing hair.

In one aspect of the method of the present invention, the step of securing with filament means the extension of hair to the clumps of naturally growing hair includes securing the extension and clumps together with a needle and thread. The thread interweaves between the extension and the clumps. In another aspect of the method of the present invention, each of the anchor means includes a crimpable object. The crimpable object has a cavity for receiving strands of hair. The step of locating and securing the anchor means includes locating one of the crimpable objects on each of the clumps such that the hair of the respective clump is received in the cavity and then crimping said crimpable object so as to secure said objects to said clumps.

In still another aspect, the method of the present invention further includes that after the extension is secured to the clumps of hair, waiting for the naturally growing hair to grow out from the skin such that the distance between the anchor means and the skin increases. Then, the extension is repositioned closer to the skin by loosening each of the anchor means and moving the loosened anchor means, the filament means and the extension means closer to the skin. Each of the anchor means is resecured to the respective clumps of naturally growing hair.

The method of the present invention uses a releasable anchor means to bind the strands of naturally growing hair together in a clump. The anchor means also provides an anchor point on the naturally growing hair so that the extension can be sewn to clumps of naturally growing hair without slipping off. The anchor means can be easily removed without damaging the naturally growing hair. By loosening the anchor means on the naturally growing hair, the position of the anchor means can be adjusted closer to the scalp to compensate for growth of the naturally growing hair away from the scalp. Thus, the extension can be easily adjusted closer to the scalp every few weeks.

BRIEF DESCRIPTION OF THE DRAWINGS

FIGS. 3–7 show detail views of the attachment method.

DESCRIPTION OF PREFERRED EMBODIMENT

The present invention is concerned with a method for attaching commercially available hair extensions, or wefts, to the hair on the head of a human. Extensions are used for stylistic and aesthetic reasons; a stylist uses extensions to add hair to the naturally growing hair on a person in order to make the overall appearance of the hair more attractive.

Figure 6:
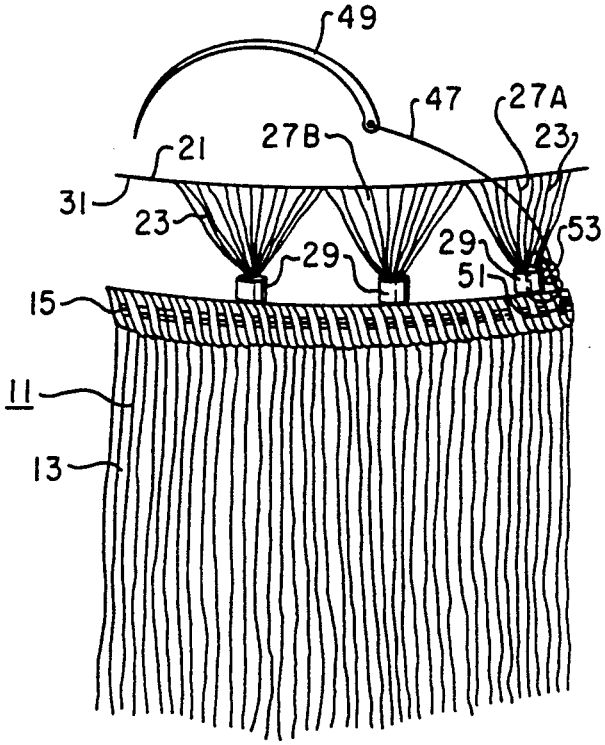

An extension 11 is shown in FIG. 6. The extension 11 is made up of multiple strands 13 of hair that are arranged side by side so as to form a flat, linear arrangement. The strands 13 are coupled together in a weave portion 15 that extends along the top end (referring to the orientation of FIG. 6) of the extension. In the weave portion 15, the strands of hair are doubled over and stitched together with thread. Extensions 11 are made with either natural hair or synthetic hair and are available in a variety of colors and textures.

Figure 1:
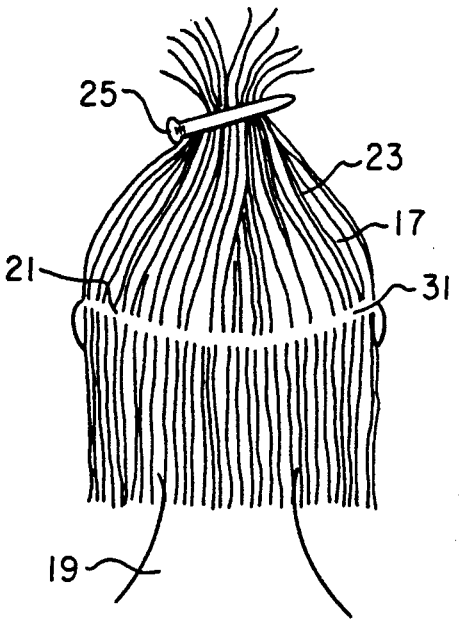
FIGS. 1–8 show the back side of a person's head, upon which the method of the present invention, in accordance with a preferred embodiment, is practiced.

Referring to FIG. 1, which shows the back of the head 17 of a person whom I shall refer to as Rapunzel, the first step in attaching an extension is to determine where on the head the extension 11 is to be attached. The extension is attached so that the weave portion 15 is generally horizontal. If more than one extension is to be attached, the lowermost extension is attached first. Typically, several extensions are attached, with the lowermost extension being attached near the nape of the neck 19. A part 21 is formed in the hair 23 along the desired location. The hair 23 on top of the part 21 is held out of the way by a clip 25.

Figure 2:
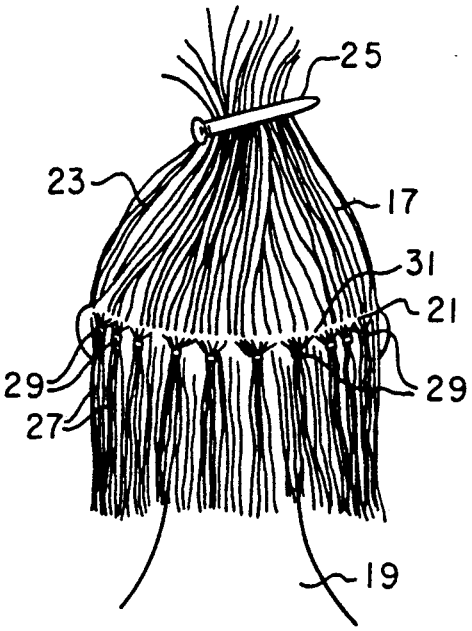

Next, referring to FIG. 2, the hair 23 along the bottom edge of the part 21 is gathered in small clumps or bunches 27. A size 9 or 10 crochet hook can be used to gather an amount of hair together into a clump. Then, an anchor sleeve 29 is located on each clump 27 and secured in place near the scalp 31. The anchor sleeves 29 bind the strands of hair 23 in a clump 27 together and serve as fixed points on the hair which are used to anchor the extension 11 in place. In the preferred embodiment, the anchor sleeves 29 are small tubular sleeves. Each sleeve 29 has a cavity 33 extending therethrough for receiving strands of hair. The anchor sleeves 29 are made of a crimpable material such as aluminum. In the preferred embodiment, the anchor sleeves are 2 mm in diameter and 2 mm in length.

Figure 3:
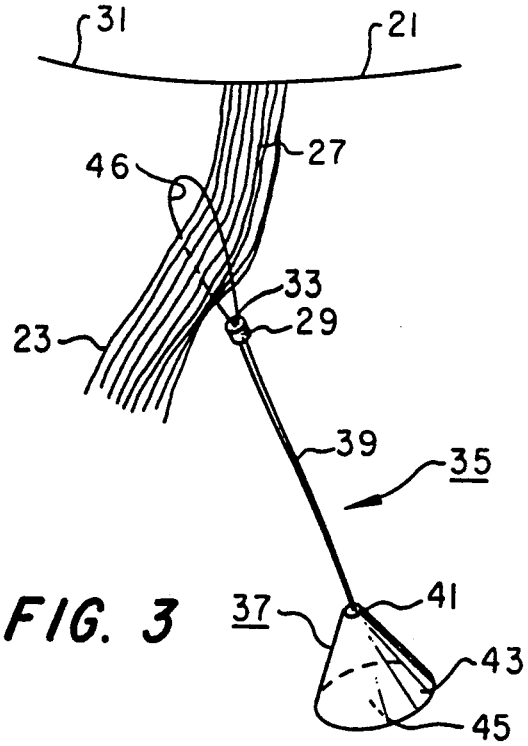

To position an anchor sleeve 29 onto a clump 27 of hair, an insertion tool 35 is used (see FIG. 3). The insertion tool 35 includes a base portion 37 and a wire portion 39. The base portion 37 is frusto-conical in shape, having top and bottom ends 41, 43. The top end 41 is narrower than the bottom end 43. The bottom end 43 has a flat bottom surface 45. The wire portion 39 is formed by a loop of wire having the free ends of the wire coupled to the top end 41 of the base portion 37. The wire 39 is relatively stiff, such that when the insertion tool is set on its bottom surface 45, the wire will project upwardly.

The wire loop 39 is inserted through the sleeve cavity 33 such that the anchor sleeve 29 can slide along the length of the loop. The anchor sleeve 29 is slid toward the base portion 37, so that the free end of the wire loop 39 can be opened. A clump 27 of hair is inserted through the opening 46 at the free end of the wire loop and then the sleeve 29 is pushed off of the wire 39 and onto the clump (see FIG. 4). The wire loop 39 pulls the hair through the sleeve cavity, so that the anchor sleeve is located on the clump of hair.

The insertion tool 35 can be loaded with plural anchor sleeves 29 on the wire loop, much like beads on a string. This allows the stylist to work rapidly when installing the anchor sleeves onto the clumps of hair. The flat bottom surface 45 of the insertion tool 35 allows the tool to be placed on a flat counter, such that the stiff wire 39 is projecting outwardly. This allows the stylist to easily pick up the insertion tool from the counter and also prevents the anchor sleeves from coming off of the wire loop.

Figure 4:
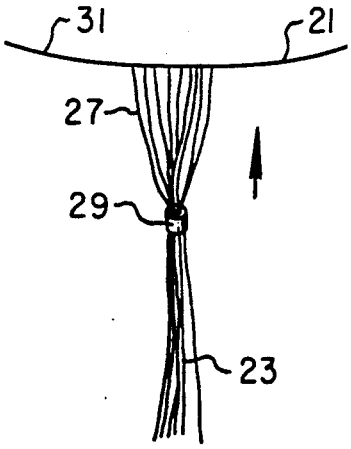

Referring to FIG. 4, when the anchor sleeve 29 is placed on a clump of hair 27, it is slid toward the scalp 1. The anchor sleeve 29 is positioned a short distance away from the scalp, where it is then clamped in place (see FIG. 5). A pair of pliers can be used to squeeze the anchor sleeves into a flattened shape. The anchor sleeves are crimped with a force acting perpendicular to the scalp such that the anchor sleeves flatten along the scalp.

Figure 5:
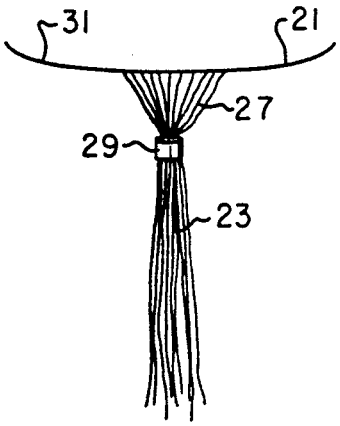
Figure 7:
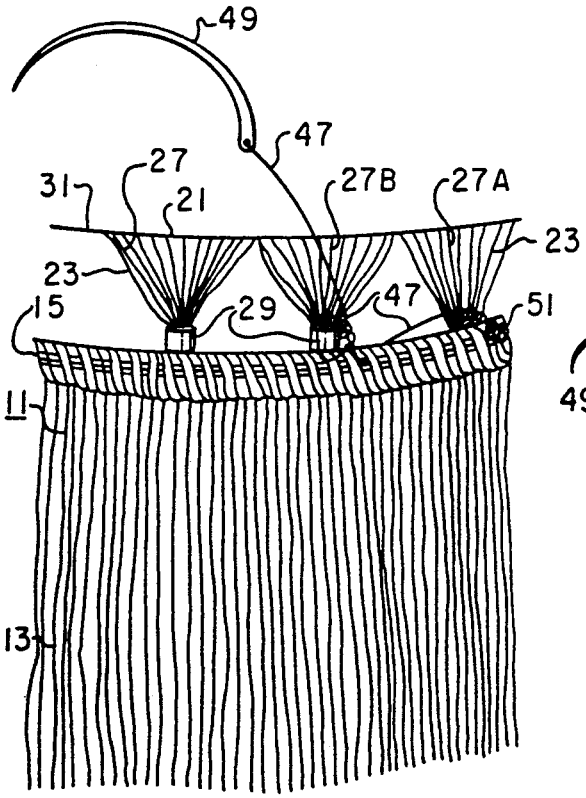

The clumps 27 of hair and their respective anchor sleeves 29 extend along the bottom of the part, as shown in FIG. 2. The anchor sleeves are spaced about ½ inch apart, except on the ends where the three endmost anchor sleeves are spaced closer together and can even be butted together. The number of hair strands 23 in a clump 27 are such that the anchor sleeve 29, being located relatively close to the scalp 31, does not pull the hair, as this could lead to hair loss. In FIGS. 5–7, the spread of hair in the clumps 27 is exaggerated for clarity.

The extension 11 of hair that is to be attached is cut to the proper running length. That is, the length of the weave portion 15 is cut slightly shorter than the length of the part 21, such that the ends of the weave portion 15 are located about ½ inch inside of Rapunzel's hair line. This allows Rapunzel to style her hair up. A small amount of glue is applied to the cut end of the extension 11, to prevent unraveling. The extension 11 is then clamped in place to the clumps 27 of hair such that the weave portion 15 of the extension extends parallel to the part 21 and is located adjacent to the anchor sleeves 29 (see FIG. 6).

The extension 11 is secured to the clumps 27 of hair with thread 47. In the preferred embodiment, cotton covered polyester thread is utilized because of its strength and its minimal stretching. A curved (or suture) needle 49 is used to sew the thread. The ends of the thread 47 are tied together so that the thread is doubled when sewn.

The needle 49 and thread 47 are inserted through one end of the weave portion 15 of the extension 11 and the thread is secured with a knot 51. This initial securing of the end of the thread to the extension may be done before the extension is clamped to Rapunzel's hair. The needle 49 and thread 47 are then passed downwardly through the endmost clump 27A of hair, at a location between the anchor sleeve 29 and the scalp 31. The thread 47 is left loose so as to form a loop 53 on the upper side of the extension. The needle and thread are then brought up through the weave portion 15, where they are looped twice around the large loop 53. The thread is then pulled tight to form a knot. The procedure is then repeated once more to form a second knot to secure the extension to the clump 27A.

Figure 8:
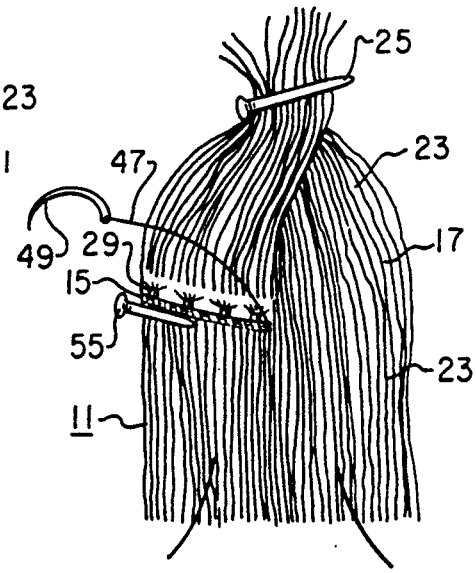

After the extension has been secured to the first clump 27A, the needle and thread are then passed through the weave portion 15 and the second clump 27B (see FIG. 7) as described above, forming two knots. The procedure is continued, so that the extension is sewn to all of the clumps. After the thread 47 is secured to the last clump 27, the thread is secured to the weave portion 15 with a knot. A small amount of glue is applied to the knot. The clip 25 is then removed, allowing Rapunzel to lower her hair. FIG. 8 shows how Rapunzel's natural hair 23 obscures from view the weave portion 15 of the extension 11. For illustration purposes, the right half of Rapunzel's hair has been let down to cover the weave portion 15. FIG. 8 also shows the clip 55 used to couple the extension 11 to the clump 27 of hair during the sewing step. The clip 55 is located below the weave portion 15 so as to not get in the way of the stylist.

After the lowermost extension has been attached, the next to lowermost extension is attached. The stylist makes another part above the lowermost extension. The procedure for attachment is then repeated with this next extension.

The method of the present invention uses binding or anchor means that both secure a number of hair strands together in a bundle and that provide a fixed anchor point on the strands. Thus, the anchor means creates an area of attachment made up of the naturally growing hair and located between the anchor means and the scalp. Then, a filament means is used to secure the extension to the individual areas of attachment. In the preferred embodiment, crimpable sleeve means are used to securely couple to the naturally growing hair. The sleeve means will not slip along the naturally growing hair and can be uncrimped for removal.

After a period of several weeks, Rapunzel's natural hair 23 will grow out. This has the effect of moving the anchor sleeves 29 and the weave portion 15 of the extension away from the scalp 31. The extension 11 can be quickly and easily readjusted to bring it closer to the scalp. The individual anchor sleeves 29 are squeezed to open them, wherein the anchor sleeves are pushed along the respective clump of hair toward the scalp 31. This pushes the thread and the extension closer to the scalp. Then, the anchor sleeves are recrimped to secure them in place. This readjusting procedure can be repeated as many times as the anchor sleeves can be recrimped.

To remove the extensions, the anchor sleeves 29 are opened and the anchor sleeves, thread and extension are pulled off of the clumps.

One aspect of the method of the present invention is that an extension of hair is more securely attached to Rapunzel's hair than with prior art methods. The method of the present invention allows an extension of hair to be securely attached to all types of hair, including straight, non-kinky hair. With her extensions securely attached, Rapunzel is free to use her hair for whatever purpose she has. Furthermore, the method of the present invention is far less damaging to Rapunzel's hair and scalp than the prior art methods of gluing and weaving.

The method of the present invention allows Rapunzel to keep her hair cleaner than with prior art methods. The attached extension also creates more volume in the hair style and allows Rapunzel's natural hair to fall freely into the style.

The foregoing disclosure and the showings made in the drawings are merely illustrative of the principles of this invention and are not to be interpreted in a limiting sense.

I claim:

1. A method of attaching an extension of hair to hair growing naturally from skin, comprising the steps of:

a) determining the location on said skin where said extension is to be attached;

b) gathering into plural clumps said naturally growing hair along said location where said extension is to be attached;

c) locating an anchor means on each clump of naturally growing hair a short distance from said skin and then securing each of said anchor means to said respective clump of naturally growing hair such that said anchor means is coupled to said respective clump;

d) securing with filament means said extension of hair to said clumps of naturally growing hair at locations between said anchor means and said skin, said filament means coupling said extension of hair to said clumps of naturally growing hair;

e) after said extension is secured to said clumps of naturally growing hair, waiting for said naturally growing hair to grow out from said skin such that the distance between said anchor means and said skin increases;

f) repositioning said extension closer to said skin by loosening each of said anchor means and moving said loosened anchor means, said filament means and said extension closer to said skin;

g) resecuring each of said anchor means to said respective clumps of naturally growing hair.

2. A method of attaching an extension of hair to hair growing naturally from skin, said extension comprising multiple strands of hair coupled together in a weave portion, comprising the steps of:

a) determining the location on said skin where said extension is to be attached;

b) parting said naturally growing hair along said determined location so as to form a part;

c) gathering said naturally growing hair along said part into plural clumps;

d) locating crimpable sleeve means to each clump of naturally growing hair, each of said sleeve means being located a short distance from said skin;

e) crimping each of said sleeve means onto said respective clumps of hair so as to secure each of said sleeve means;

f) locating said extension adjacent to said clumps of naturally growing hair such that said weave portion is adjacent to said sleeve means;

g) coupling said extension weave portion to said clumps of said naturally growing hair by passing a needle and thread back and forth between said clumps of naturally growing hair and said weave portion, said needle and thread passing through said respective clumps of naturally growing hair at a location between said sleeve means and said skin;

h) after said extension is secured to said clumps of naturally growing hair, waiting for said naturally growing hair to grow out from said skin such that the distance between said sleeve means and said skin increases;

i) repositioning said extension closer to said skin by loosening each of said sleeve means and moving said loosened sleeve means, said filament means and said extension closer to said skin;

j) resecuring each of said sleeve means to said respective clumps of naturally growing hair.

* * * * *